US008189026B2

(12) United States Patent
Izawa et al.

(10) Patent No.: US 8,189,026 B2
(45) Date of Patent: May 29, 2012

(54) METHOD AND APPARATUS FOR CORRECTING PRINT IMAGES IN AN ELECTROPHOTOGRAPHIC PRINTER

(75) Inventors: Hideo Izawa, Narashino (JP); Yasushi Katagiri, Narashino (JP); Osamu Ebuchi, Narashino (JP)

(73) Assignee: Miyakoshi Printing Machinery Co., Ltd., Narashino-shi (JP)

( * ) Notice: Subject to any disclaimer, the term of this patent is extended or adjusted under 35 U.S.C. 154(b) by 0 days.

(21) Appl. No.: 13/023,045

(22) Filed: Feb. 8, 2011

(65) Prior Publication Data

US 2011/0199452 A1 Aug. 18, 2011

(30) Foreign Application Priority Data

Feb. 15, 2010 (JP) ..... 2010-30042

(51) Int. Cl.
*G03G 15/00* (2006.01)

(52) U.S. Cl. ..... 347/234; 347/16; 347/19; 399/36; 399/167

(58) Field of Classification Search ..... 347/234, 347/248, 14, 19, 16; 399/36, 167
See application file for complete search history.

(56) References Cited

U.S. PATENT DOCUMENTS 4,965,597 A 10/1990 Ohigashi et al.
7,510,256 B2 * 3/2009 Guarino et al. ..... 347/19
2006/0274377 A1 12/2006 Chun
2007/0253736 A1 11/2007 Ehara et al.
2009/0073515 A1 3/2009 Takachi

FOREIGN PATENT DOCUMENTS

JP 2659191 B2 9/1997

OTHER PUBLICATIONS

Extended European search report dated Jun. 1, 2011, issued in corresponding European Patent Application No. 11153171.1.

* cited by examiner

*Primary Examiner* — Julian Huffman
(74) *Attorney, Agent, or Firm* — Westerman, Hattori, Daniels & Adrian, LLP

(57) ABSTRACT

A method of correcting print images in an electrophotographic printer wherein an image formed by a print head (3) on a peripheral surface of a photoconductor drum (1) is transferred and printed on a sheet of paper. The method comprises: furnishing the print head with a standard tacho signal in the form of pulses and thereby printing on a sheet of paper a check mark (9) for each given number of pulses of the standard tacho signal while the photoconductor drum makes one rotation; by means of a camera (10), detecting a periodic deviation in each spacing between successive such check marks; in response to the deviation in each spacing between the successive check marks, varying the pulse width of pulses of the standard tacho signal for each spacing between the successive check marks, thereby to provide a modified tacho signal; and effecting printing thereafter based on the modified tacho signal.

8 Claims, 3 Drawing Sheets

METHOD AND APPARATUS FOR CORRECTING PRINT IMAGES IN AN ELECTROPHOTOGRAPHIC PRINTER

TECHNICAL FIELD

The present invention relates to a method and apparatus for correcting print images in an electrophotographic printer using a photoconductor drum whereby a periodic deviation in image transfer position caused by working distortion and/or fitting error for each of photoconductor drums at their exchange time is automatically corrected.

BACKGROUND ART

In an electrophotographic printer, exchanging photoconductor drums in a service or maintenance operation may give rise to an axial runout or out-of-round distortion due to working distortion or fitting error for each photographic drum exchanged, which unevenly varies the distance between the peripheral surface of the photoconductor drum and its rotary shaft center, that is its turning radius. Driving the photoconductor drum in such a state at a fixed angular speed of rotation causes the peripheral speed of the photoconductor drum to be varied or changed periodically, whereby a toner image from the photoconductor drum onto a sheet of paper is periodically deviated in transfer position. A change in peripheral speed of a photoconductor drum may also be caused by a radial runout or working error of a driving means such as gear, belt or the like for driving the photoconductor drum.

To cope with such an inconvenience, the conventional means for correcting a deviation in transfer position of an image has been that in which for each formation of the image from a photoconductor drum a registration mark is printed on a traveling body having a fixed registration mark preprinted to detect an amount of deviation in spacing between the two registration marks at all times during each image formation to effect correction of image forming position as shown in JP 2,659,191 B.

The conventional technique presents the problem that a deviation must be monitored at all times for each print image and that errors in correction due to errors in reading the moving body for correaction of the deviation are entailed at all times.

In view of the aforementioned, it is an object of the present invention to provide a method and apparatus for correcting printing images whereby a periodic deviation in image transfer position caused by working distortion and/or fitting error for each photoconductor drum can be corrected simply and less costly by only onetime measurement and correction at the time of exchanging photoconductor drums.

DISCLOSURE OF THE INVENTION

In order to achieve the object mentioned above, there is provided in accordance with the present invention a method for correcting print images in an electrophotographic printer wherein an image formed by a print head on a peripheral surface of a photoconductor drum is transferred and printed on a sheet of paper, which comprises: furnishing the print head with a standard tacho signal in the form of pulses and thereby printing on a sheet of paper a check mark for each given number of pulses of the standard tacho signal while the photoconductor drum makes one rotation; by means of a camera, detecting a periodic deviation, change or difference in each spacing between successive such check marks; in response to the deviation in each spacing between the successive check marks, varying the pulse width of pulses of the standard tacho signal for each spacing between the check marks, thereby to provide a modified tacho signal; and effecting printing thereafter based on the modified tacho signal.

And, in the print image correcting method mentioned above, after the check marks are made constant in spacing subsequent to furnishing of the modified tacho signal, the check marks are no longer necessarily printed.

The present invention also provides an apparatus for carrying out the method mentioned above, i.e., an apparatus for correcting print images in an electrophotographic printer wherein an image formed by a print head on a peripheral surface of a photoconductor drum is transferred and printed on a sheet of paper, which comprises: a photoconductor rotary position detecting means for detecting a rotary position of the photoconductor drum; a pulse generator means responsive to an input signal from the photoconductor rotary position detecting means for furnishing the print head with a tacho signal in the form of pulses while the photoconductor drum makes one rotation; a control unit for controlling the tacho signal furnished from the pulse generator means into the print head to cause a check mark to be printed for each given number of pulses of the tacho signal on the sheet of paper while the photoconductor drum makes one rotation; and a camera for detecting a deviation, change or difference in each spacing between successive such check marks printed from the photoconductor drum on the sheet of paper, wherein said control unit is responsive to a detection value detected by the camera to vary the pulse width of pulses of the tacho signal for each spacing between the successive check marks for furnishing a modified tacho signal into the print head.

This method of correcting print images in an electrophotographic printer allows a periodic deviation in image transfer position on a sheet of paper caused by working distortion and/or fitting error for each photoconductor drum to be reduced by only onetime measurement and correction at the time of exchanging photoconductor drums.

Also, reading out check marks (registration marks) is only performed in a corrective operation and is no longer used in printing products. Hence, even in high-speed printing, no readout error may be produced and a deviation in image transfer position on a sheet of paper can be accurately corrected, while making it possible to hold down the toner and power consumption in mark printing and readout.

Besides, the aforesaid print image correcting method according to the present invention lightens the burden of an operator while exchanging photoconductor drums, and improves the net working rate and operability of an electrophotographic printer.

The aforesaid print image correcting apparatus in an electrophotographic printer according to the present invention allows the print image correcting method mentioned above to be carried out less costly and simply.

BEST MODES FOR CARRYING OUT THE INVENTION

Figure 1:
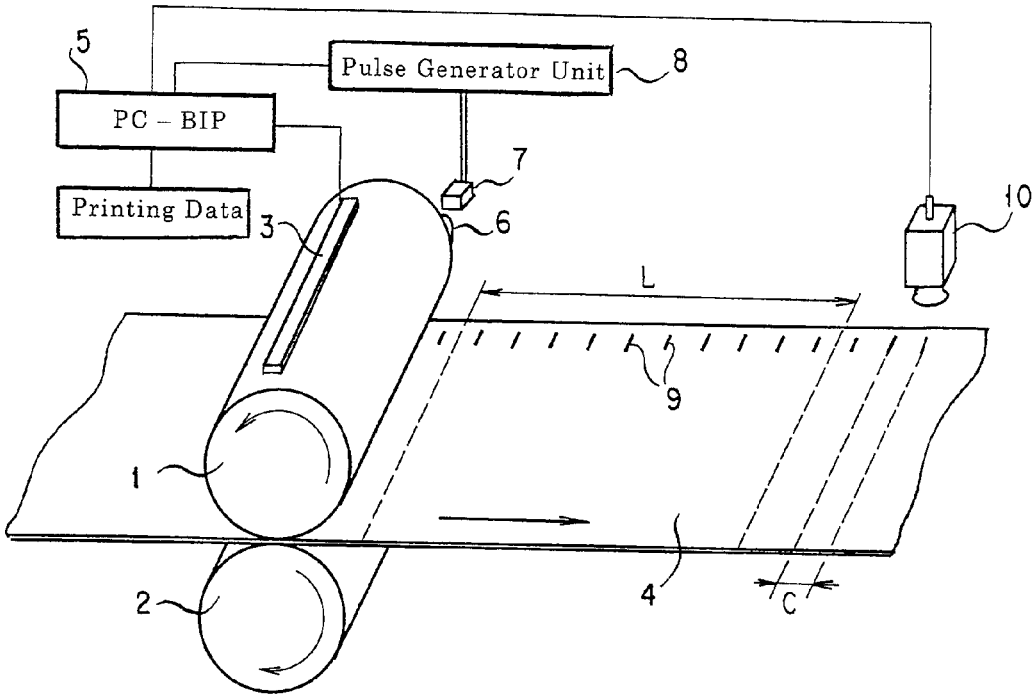
FIG. 1 is an explanatory view diagrammatically illustrating an apparatus for carrying out a method according to the present invention.

Mention is made of a form of implementation of the present invention with reference to the Drawing Figures.

FIG. 1 diagrammatically shows an apparatus for carrying out a method of the present invention. In the Figure there are shown a photoconductor drum 1, a backup roller 2 in rotational contact with the photoconductive drum 1 and a print head 3 for forming a latent image on the photoconductor drum 1. The latent image formed by the print head 3 on the photoconductor drum 1 is visualized by a developing unit (not shown) which is provided opposed to a peripheral surface of the photoconductor drum 1 downstream of the print head 3 in the rotary direction of the drum 1. The visualized image is printed on a sheet of paper (printable material) 4 traveling between the photoconductor drum 1 and the backup roller 2.

The print head 3 used here is an LED unit head, in which dot light sources corresponding to print image dots are arranged in a line in a longitudinal direction of the print head to blink the dot light sources according to a print image. And, when a control unit 5 using a PC-BIP (Personal Computer—Bitmap Image Processer) is furnished with a tacho (TACH) signal and a CUE signal (printing start signal), the print head 3 is furnished with printing data developed by the control unit 5.

The photoconductor drum 1 is provided on its one end face with an iron piece 6, and at a position opposed to the end face of the photoconductor drum 1 provided with the iron piece 6 there is provided a proximity sensor 7 for sensing a passage of the iron piece 6 each for one rotation of the photoconductor drum 1. And, reading out a passage of the iron piece 6 and thereby detecting an origin of the photoconductor drum 1 in its rotary direction, the proximity sensor 7 is arranged to furnish a signal of such detection to a pulse generator unit 8. From the pulse generator unit 8, a tacho signal of, e.g., 1260 pulses are furnished in a time from the origin to the origin, i.g., during one rotation of the photoconductor drum 1.

The tacho signal is a timing signal in the form of pulses to cause the LED unit of the print head 3 to scan and emit light once every given number of pulses. The tacho signal in each cycle is composed of a standard waveform S1 of pulses of a fixed frequency, e.g., 1260 pulses which are produced from the pulse generator unit 8 in a time period after the origin is detected until it is next detected (during one rotation of the photoconductor drum 1).

Here, when e.g., at regular dimensional points Co1, Co2, Co3, . . . , and Co126 every 10 pulses, scanning by and light emission from the LED unit of the print head 3 is effected to expose the peripheral surface of the photoconductor drum 1 to light, successive checkmark images are formed thereon at a spacing C equivalent to 10 pulses and a check mark 9 is printed on the sheet of paper 4. Then, 126 such successive check marks 9 are printed for one rotation of the photoconductor drum 1, over a peripheral length L of the photoconductor drum 1 (in FIG. 1 they are shown in a simplified view in this regard). And, the spacing C between successive check marks 9 is detected by a camera 10 and fed back to the control unit 5.

Figure 2:
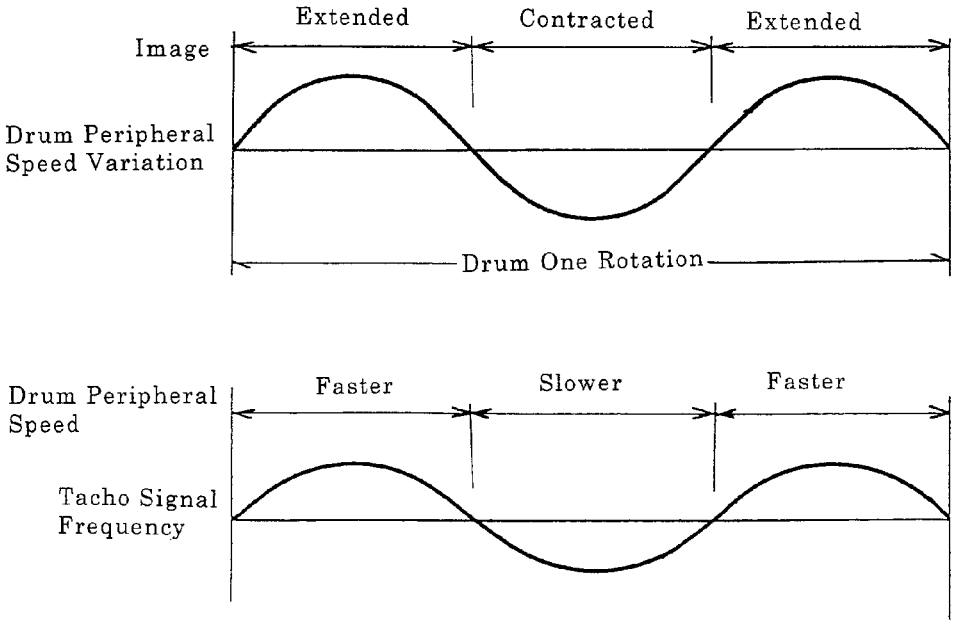
FIG. 2 is an explanatory view illustrating a variation in peripheral speed of a photoconductor drum for one rotation of the drum and a modification of the frequency of a tacho signal vis-a-vis such a variation.

However, due to working distortion or fitting error of the photoconductor drum 1 or radial runout of the drive system, it has been found that there occurs a periodic variation or change in peripheral speed of the photoconductor drum 1 as shown in the upper graph in FIG. 2 while the photoconductor drum 1 makes one rotation. Then, with a fixed pulse width in standard waveform S1 of a tacho signal, the image (or spacing between adjacent check marks) becomes extended on a portion where the drum is higher (faster) in peripheral speed and the image becomes contracted on a portion where the drum is lower (slower) in peripheral speed. Consequently, the spacing C between adjacent check marks 9 printed on the sheet of paper 4 becomes varied with changes in peripheral speed of the photoconductor drum 1.

More specifically, the spacing C between check marks 9 on the portion where the image is extended is longer than the spacing by 10 pulses between aforesaid successive regular dimensional points and for example is a spacing equivalent to 12 pulses or 11 pulses. On the other hand, the spacing C between check marks 9 on the portion where the image is contracted is shorter than the spacing by 10 pulses between the successive regular dimensional points and for example is a spacing equivalent to 9 pulses or 8 pulses.

In order to cancel out such extension and contraction of an image, it is proposed as shown in the lower graph in FIG. 2 to modify the tacho signal, i.e., to change the frequency of the tacho signal so as to increase the frequency of the tacho signal (or to shorten the pulse width) at a portion where the image tend to be extended to effect printing there in a shortened time and so as to decrease the frequency of the tacho signal (or to lengthen the pulse width) at a portion where the image tends to be contracted to effect printing there in a lengthened time.

Since the number of pulses of the tacho signal per one rotation of the photoconductor drum 1 is fixed, increasing the frequency of the tacho signal in case the image tends to be extended means increasing the number of pulses per unit time then and decreasing the frequency of the tacho signal in case the image tends to be contracted means decreasing the number of pulses per unit time then. Such modification of the tacho signal is performed by the PC-BIP in the control unit 5. And, by driving the print head 3 (causing it to scan and emit light) with a compensation value of the pulse width acquired by this control which is proper to the particular photoconductor drum 1, it is possible to cancel the periodic extension and contraction of the image which has arisen from variations in peripheral speed of the photoconductor drum 1 and to reduce deviations in image transfer position all the time while a product is being printed. Note here that once such compensation is completed, it becomes unnecessary to print a check mark 9.

Figure 3:
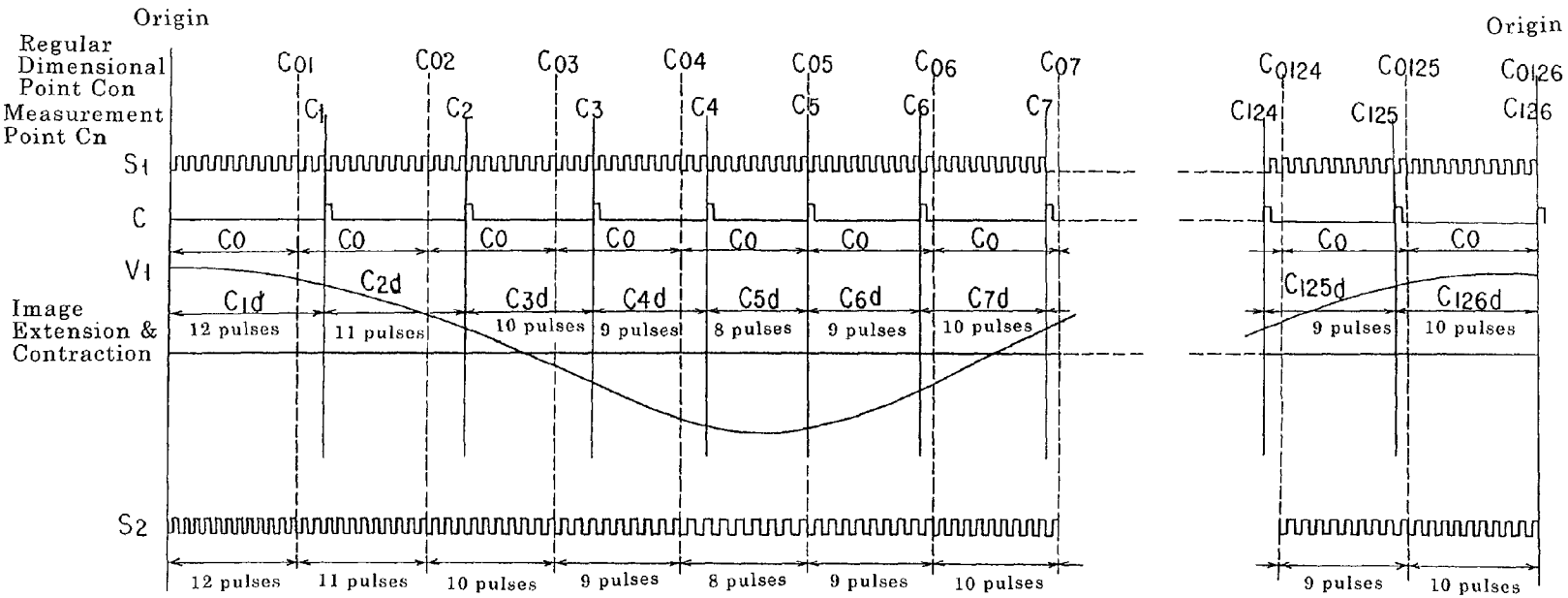
FIG. 3 is a graph explanatory of modifications of the tacho signal frequency vis-a-vis variations in peripheral speed of the photoconductor drum.

FIG. 3 is a graphical view illustrating the modification of a tacho signal vis-a-vis variations in peripheral speed of the photoconductor drum 1.

In FIG. 3, the number of pulses of a tacho signal per one rotation of the photoconductor drum 1 is 1260 pulses. The tacho signal is a timing signal for causing the print head 3 to scan and emit light once per a given number of pulses and has standard waveform S1 of pulses furnished from the pulse generator unit 8 at a fixed frequency (with an equal pulse width) after the origin is detected until the origin is next detected (for one rotation of the photoconductor drum 1).

Here, the LED unit of the print head 3 is caused to scan and emit light for exposure on the photoconductor drum 1 at regular dimensional points Co1, Co2, Co3, . . . , and Co126 spaced apart from each other with a fixed distance Co, e.g, of every 10 pulses of standard waveform S1. Then, checkmark images are formed on the photoconductor drum 1 at a pitch equivalent to 10 pulses, namely at regular dimensional points (Co1, Co2, Co3, . . . , and Co126), respectively, whereby check marks 9 are printed as shown in FIG. 1. And, these check marks 9 and their respective spacing or intervals are successively measured by the camera 10 as at measurement points C1, C2, C3, . . . .

Thence, when the peripheral speed of the photoconductor drum 1 as mentioned above is periodically varied as V1, results of this are measured by the camera 10. As for spacing or intervals measured between measurement points C1, C2, C3, . . . , for the check marks 9 printed at the pitch Co equivalent to 10 pulses, and their respective, immediately preceding measurement points, a spacing C1*d* and a spacing C2*d* at measurement points C1 and C2 where the peripheral speed is faster become equivalent to 12 pulses and 11 pulses, respectively, indicating extensions of the image (or spacing between adjacent check marks). On the other hand, a spacing Cod, a spacing C5*d* and a spacing C6*d* as at measurement points C4, C5 and C6 where the peripheral speed is slower become equivalent to 9 pulses, 8 pulses and 9 pulses, respectively, indicating contractions of the image.

The spacing C1*d*, C2*d*, C3*d*, . . . , between measurement points C1, C2, C3, . . . , and their respective immediately preceding measurement points are detected by the camera 10 whose detection values are fed back to the control unit 5. The control unit 5 is arranged to output a modified tacho signal S2 as shown in FIG. 3, which is modified based on those detection values.

The modified tacho signal S2 to cancel out extension and contraction of the image is to modify the standard tacho signal S1 so as to increase the frequency such as at measurement points C1 and C2 where the image tends to be extended to cause the LED unit of the print head 3 to scan and emit light there at an advanced timing and, conversely, so as to decrease the frequency such as at measurement points C3, C4 and C5 where the image tends to be contracted to cause the LED unit of the print head 3 to scan and emit light there at a retarded timing.

To wit, the modified tacho signal S2 has the frequency increased until it reaches regular dimensional points Co1 and Co2 so that between the regular dimensional point Co1 and its immediately preceding regular dimensional point there are delivered 12 pulses in a period of 10 pulses in the standard tacho signal S1 and between the regular dimensional point Co2 and its immediately preceding regular dimensional point there are delivered 11 pulses in the period of 10 pulses in the standard tacho signal S1. Thereafter, the frequency is decreased so that between the regular dimensional point Co5 and its immediately preceding regular dimensional point there are delivered 8 pulses in the period of 10 pulses in the standard tacho signal S1 and between the regular dimensional point Co6 and its immediately preceding regular dimensional point there are delivered 9 pulses in the period of 10 pulses in the standard tacho signal S1. In this way, the pulse width of pulses of the tacho signal is modified at each of regular dimensional points Co1 to Co126.

With a tacho signal modified as above S2, the LED unit of the print head 3 is caused, once every 10 pulses to scan and emit light and to print a check mark 9 as with the standard tacho signal S1. At measurement points C1 and C2 where the image tends to be extended with the peripheral speed of the photoconductor 1 made faster, pulses of the modified tacho signal has a narrowed pulse width so that exposure with every 10 pulses is effected at a timing quicker than with those before modification. Conversely, at measurement points C4, C5, C6 where the image tends to be contracted with the peripheral speed of the photoconductor 1 made slower, pulses of the modified tacho signal has a widened pulse width so that exposure with every 10 pulses is effected at a timing later than with those before modification. This allows checkmark images to be formed on the photoconductor drum 1 at a pitch Co that is an equivalent of 10 pulses, whereafter they are transferred to the sheet of paper 4. The check marks 9 then transferred onto the sheet of paper 4 are equally spaced apart at a given spacing or distance C.

After it is confirmed that the check marks 9 printed on the sheet of paper 4 are equally spaced apart at the distance C, the print head 3 continues to be furnished with the modified tacho signal S2, but check marks every 10 pulses are no longer printed.

Figure 4:
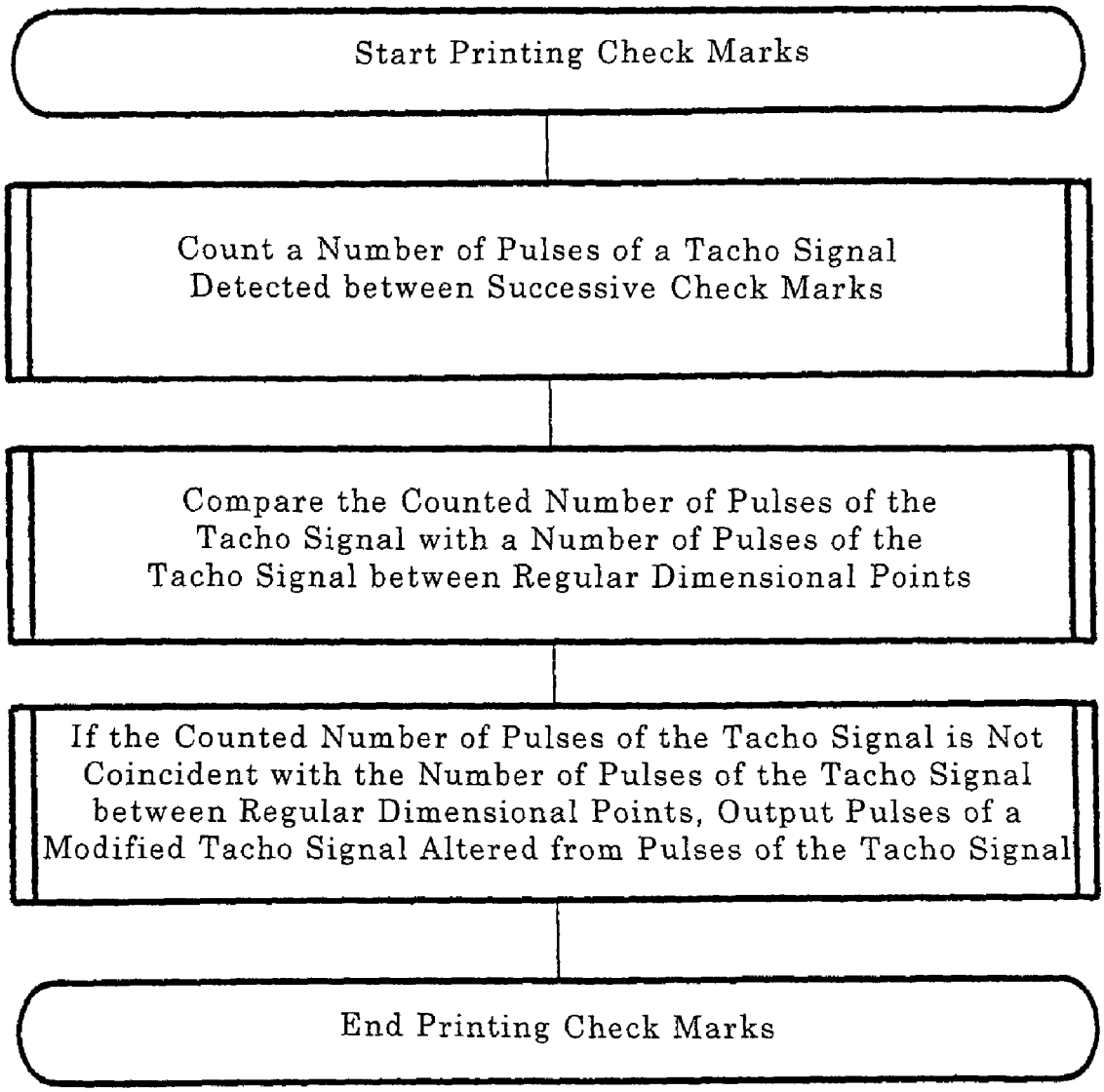
FIG. 4 is a flow chart illustrating a method of the present invention.

A flow chart of the operations mentioned above can be described as shown in FIG. 4. As shown in the Figure, one first starts printing check marks 9 on a sheet of paper 4 (step 1). Next, one counts a number of pulses of a tacho signal detected by the camera 10 as between successive check marks 9 (step 2). Then, the counted number of pulses of the tacho signal between the check marks is compared with a preselected number of pulses of the tacho signal in a fixed time interval between regular dimensional points (step 3). If the counted number of pulses of the tacho signal is not coincident with the selected number of pulses in the fixed time interval between regular dimensional points, pulses of the tacho signal output are altered into pulses of a modified tacho signal output (step 4). Thereafter, one ends printing check marks 9 (step 5).

What is claimed is:

1. A method of correcting print images in an electrophotographic printer wherein an image formed by a print head on a peripheral surface of a photoconductor drum is transferred and printed on a sheet of paper, characterized in that it comprises the steps of:

furnishing the print head with a standard tacho signal in the form of pulses and thereby printing on a sheet of paper a check mark for each given number of pulses of the standard tacho signal while the photoconductor drum makes one rotation;

by a camera, detecting a periodic deviation in each spacing between successive such check marks;

in response to the deviation in each spacing between the successive check marks, varying the pulse width of pulses of the standard tacho signal for each spacing between the successive check marks, thereby to provide a modified tacho signal; and effecting printing thereafter based on the modified tacho signal.

2. A method of correcting print images in an electrophotographic printer as set forth in claim 1, characterized in that after the check marks are made constant in spacing subsequent to furnishing of the modified tacho signal, the check marks are no longer printed.

3. A method of correcting print images in an electrophotographic printer as set forth in claim 1, further including the control unit counting a number of pulses of a tacho signal detected between successive check marks and comparing the counted number of pulses of the tacho signal with a number of pulses of the tacho signal between regular dimensional check mark points.

4. A method of correcting print images in an electrophotographic printer as set forth in claim 1, including upon detecting an origin using a sensor, said pulse generator generates pulses at a fixed frequency until the photoconductor drum makes one rotation until the origin is next detected.

5. An apparatus for correcting print images in an electrophotographic printer wherein an image formed by a print head on a peripheral surface of a photoconductor drum is transferred and printed on a sheet of paper, characterized in that it comprises:

a proximity sensor for detecting a rotary position of the photoconductor drum;

a pulse generator responsive to an input signal from the proximity sensor for furnishing the print head with a tacho signal in the form of pulses while the photoconductor drum makes one rotation;

a control unit for controlling the tacho signal furnished from the pulse generator into the print head to cause a check mark to be printed for each given number of pulses of the tacho signal on the sheet of paper while the photoconductor drum makes one rotation; and a camera for detecting a deviation in each spacing between successive such check marks printed from the photoconductor drum on the sheet of paper, wherein said control unit is responsive to a detection value detected by the camera to vary the pulse width of pulses of the tacho signal for each spacing between the successive check marks for furnishing a modified tacho signal into the print head.

6. An apparatus for correcting print images in an electrophotographic printer as set forth in claim 5, wherein said control unit is configured such that after the check marks are made constant in spacing subsequent to furnishing of the modified tacho signal, the check marks are no longer printed.

7. An apparatus for correcting print images in an electrophotographic printer as set forth in claim 5, including upon detecting an origin using the proximity sensor, said pulse generator generating pulses at a fixed frequency until the photoconductor drum makes one rotation until the origin is next detected.

8. An apparatus for correcting print images in an electrophotographic printer as set forth in claim 5, further including the control unit counts a number of pulses of a tacho signal detected between successive check marks and compares the counted number of pulses of the tacho signal with a number of pulses of the tacho signal between regular dimensional check mark points.

* * * * *